US007162417B2

(12) United States Patent
Yamada et al.

(10) Patent No.: US 7,162,417 B2
(45) Date of Patent: Jan. 9, 2007

(54) SPEECH SYNTHESIZING METHOD AND APPARATUS FOR ALTERING AMPLITUDES OF VOICED AND INVOICED PORTIONS

(75) Inventors: Masayuki Yamada, Kawasaki (JP); Yasuhiro Komori, Kawasaki (JP); Mitsuru Otsuka, Iwatsuki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 11/181,462

(22) Filed: Jul. 13, 2005

(65) Prior Publication Data

US 2005/0251392 A1 Nov. 10, 2005

Related U.S. Application Data

(63) Continuation of application No. 09/386,049, filed on Aug. 30, 1999, now Pat. No. 6,993,484.

(30) Foreign Application Priority Data

Aug. 31, 1998 (JP) ..... 10-245950

(51) Int. Cl.
*G10L 11/06* (2006.01)
*G10L 13/02* (2006.01)

(52) U.S. Cl. ..... 704/214; 704/261; 704/269

(58) Field of Classification Search ..... 704/208, 704/214, 258, 261, 265, 266, 267, 269
See application file for complete search history.

(56) References Cited

U.S. PATENT DOCUMENTS

| | | | |
|---|---|---|---|
| 4,071,695 | A | 1/1978 | Flanagan et al. |
| 4,128,737 | A | 12/1978 | Dorais |
| 4,393,272 | A | 7/1983 | Itakura et al. |
| 4,433,210 | A | 2/1984 | Ostrowski et al. |
| 4,461,024 | A | 7/1984 | Rengger et al. |
| 5,091,952 | A | 2/1992 | Williamson et al. |
| 5,327,520 | A | 7/1994 | Chen |
| 5,774,836 | A | 6/1998 | Bartkowiak et al. |
| 5,978,764 | A | 11/1999 | Lowry et al. |
| 6,067,519 | A | 5/2000 | Lowry |
| 6,112,178 | A | 8/2000 | Kaja |

(Continued)

FOREIGN PATENT DOCUMENTS

JP A 05-158129 3/1994

(Continued)

OTHER PUBLICATIONS

A copy of the Japanese Office Action dated Jun. 28, 2004 issued in counterpart Japanese Patent Application 10-245950.

(Continued)

*Primary Examiner*—Martin Lerner
(74) *Attorney, Agent, or Firm*—Morgan & Finnegan, L.L.P.

(57) ABSTRACT

An amplitude altering magnification (r) applied to sub-phoneme units of a voiced portion and an amplitude altering magnification s to be applied to sub-phoneme units of an unvoiced portion are determined based upon a target phoneme average power ($p_0$) of synthesized speech and power (p) of a selected phoneme unit. Sub-phoneme units are extracted from a phoneme to be synthesized. From among the extracted sub-phoneme units, a sub-phoneme unit of the voiced portion is multiplied by the amplitude altering magnification (r), and a sub-phoneme unit of the unvoiced portion is multiplied by the amplitude altering magnification (s). Synthesized speech is obtained using the sub-phoneme units thus obtained. This makes it possible to realize power control in which any decline in the quality of synthesized speech is reduced.

18 Claims, 7 Drawing Sheets

U.S. PATENT DOCUMENTS

| | | | | |
|---|---|---|---|---|
| 6,125,346 | A | 9/2000 | Nishimura et al. | |
| 6,832,192 | B1 * | 12/2004 | Yamada | 704/260 |
| 6,993,484 | B1 * | 1/2006 | Yamada et al. | 704/261 |
| 7,054,806 | B1 * | 5/2006 | Yamada | 704/207 |
| 7,054,815 | B1 * | 5/2006 | Yamada et al. | 704/267 |
| 2001/0029454 | A1 * | 10/2001 | Yamada | 704/258 |
| 2001/0037202 | A1 * | 11/2001 | Yamada et al. | 704/258 |
| 2006/0129404 | A1 * | 6/2006 | Yamada | 704/261 |

FOREIGN PATENT DOCUMENTS

| | | |
|---|---|---|
| JP | A 06-050890 | 6/1995 |
| JP | A 06-222314 | 4/1996 |
| JP | A 08-039981 | 2/1997 |
| JP | A 08-232388 | 3/1998 |
| JP | A 08-329845 | 6/1998 |
| WO | 97/26648 | 7/1997 |

OTHER PUBLICATIONS

Search Report dated Feb. 1, 2001.

Hirokawa T., et al. "High Quality Speech Synthesis System Based on Waveform Concatenation Of Pheoneme Segment", IEICE Transactions on FundaMentals of Electronics, Communications and Computer Sciences, JP, Institute of Electronics Information and Comm. Eng. Tokyo, vol. 76A, No. 22, Nov. 1, 1993.

Definition of "Prosody", Compact Oxford English Dictionary, 2005, 1 Page.

Definition of "Prosody", Merriam-Webster Online Dictionary, 1 Page.

Definition of "Prosody", Wikipedia, 1 Page.

English abstract (Patent Abstracts of Japan Publication No. 07-152396) corresponding to Item A.

English abstract (Patent Abstracts of Japan Publication No. 08-087295) corresponding to Item B.

English abstract (Patent Abstracts of Japan Publication No. 06-083400) corresponding to Item C.

English abstract (Patent Abstracts of Japan Publication No. 10-074095) corresponding to Item D.

English abstract (Patent Abstracts of Japan Publication No. 09-044191) corresponding to Item E.

English abstract (Patent Abstracts of Japan Publication No. 10-171484) corresponding to Item F.

* cited by examiner

Prior Art

Prior Art

SPEECH SYNTHESIZING METHOD AND APPARATUS FOR ALTERING AMPLITUDES OF VOICED AND INVOICED PORTIONS

This is continuation of application Ser. No. 09/386,049, filed Aug. 30, 1999 now U.S. Pat. No. 6,993,484.

BACKGROUND OF THE INVENTION

This invention relates to a speech synthesizing method and apparatus and, more particularly, to a speech synthesizing method and apparatus for controlling the power of synthesized speech.

A conventional speech synthesizing method that is available for obtaining desired synthesized speech involves dividing a pre-recorded phoneme unit into a plurality of sub-phoneme units and subjecting the sub-phoneme units obtained as a result to processing such as interval modification, repetition and thinning out to thereby obtain a composite sound having a desired duration and fundamental frequency.

FIGS. 5A to 5D are diagrams schematically illustrating a method of dividing a speech waveform into sub-phoneme units. A speech waveform shown in FIG. 5A is divided into sub-phoneme units of the kind illustrated in FIG. 5C using an extracting window function of the kind shown in FIG. 5B. Here an extracting window function synchronized to the pitch interval of original speech is applied to the portion of the waveform that is voiced (the latter half of the speech waveform), and an extracting window function having an appropriate interval is applied to the portion of the waveform that is unvoiced.

The duration of synthesized speech can be shortened by thinning out and then using these sub-phoneme units obtained by the window function. The duration of synthesized speech can be lengthened, on the other hand, by using these sub-phoneme units repeatedly.

By reducing the interval of the sub-phoneme units in the voiced portion, it is possible to raise the fundamental frequency of synthesized speech. Widening the interval of the sub-phoneme units, on the other hand, makes it possible to lower the fundamental frequency of synthesized speech.

Desired synthesized speech of the kind indicated in FIG. 5D is obtained by superposing the sub-phoneme units again after the repetition, thinning out and interval modification described above.

Control of the power of synthesized speech is performed in the following manner: In a case where phoneme average power $p_0$ serving as a target is given, average power p of synthesized speech obtained through the above-described procedure is determined and synthesized speech obtained through the above-described procedure is multiplied by $\sqrt{p_0/p}$ to thereby obtain synthesized speech having the desired average power. It should be noted that power is defined as the square of the amplitude or as a value obtained by integrating the square of the amplitude over a suitable interval. The volume of a composite sound is large if the power is large and small if the power is small.

FIGS. 6A to 6E are diagrams useful in describing ordinary control of the power of synthesized speech. The speech waveform, extracting window function, sub-phoneme units and synthesized waveform of in FIGS. 6A to 6D correspond to those of FIGS. 5A to 5D, respectively. FIG. 6E illustrates power-controlled synthesized speech obtained by multiplying the synthesized waveform of FIG. 6D by $\sqrt{p_0/p}$.

With the method of power control described above, however, unvoiced portions and voiced portions are enlarged by the same magnification and, as a result, there are instances where the unvoiced portions develop abnormal noise-like sounds. This leads to a decline in the quality of synthesized speech.

SUMMARY OF THE INVENTION

Accordingly, an object of the present invention is to provide a speech synthesizing method and apparatus for implementing power control in which any decline in the quality of synthesized speech is reduced.

According to one aspect of the present invention, the foregoing object is attained by providing a method of synthesizing speech comprising: a magnification acquisition step of obtaining, on the basis of target power of synthesized speech, a first magnification to be applied to sub-phoneme units of a voiced portion and a second magnification to be applied to sub-phoneme units of an unvoiced portion; an extraction step of extracting sub-phoneme units from a phoneme to be synthesized; an amplitude altering step of altering amplitude of a sub-phoneme unit of a voiced portion, based upon the first magnification, from among the sub-phoneme units extracted at the extraction step, and altering amplitude of a sub-phoneme unit of an unvoiced portion, from among the sub-phoneme units extracted at the extraction step, based upon the second magnification; and a synthesizing step of obtaining synthesized speech using the sub-phoneme units processed at the amplitude altering step.

According to another aspect of the present invention, the foregoing object is attained by providing an apparatus for synthesizing speech comprising: magnification acquisition means for obtaining, on the basis of target power of synthesized speech, a first magnification to be applied to a sub-phoneme unit of a voiced portion and a second magnification to be applied to a sub-phoneme unit of an unvoiced portion; extraction means for extracting sub-phoneme units from a phoneme to be synthesized; amplitude altering means for multiplying a sub-phoneme unit of a voiced portion, from among the sub-phoneme units extracted by the extraction means, by a first amplitude altering magnification, and multiplying a sub-phoneme unit of an unvoiced portion, from among the sub-phoneme units extracted by the extraction means, by a second amplitude altering magnification; and synthesizing means for obtaining synthesized speech using the sub-phoneme units processed by the amplitude altering means.

Other features and advantages of the present invention will be apparent from the following description taken in conjunction with the accompanying drawings, in which like reference characters designate the same or similar parts throughout the figures thereof.

BRIEF DESCRIPTION OF THE DRAWINGS

The accompanying drawings, which are incorporated in and constitute a part of the specification, illustrate embodiments of the invention and, together with the description, serve to explain the principles of the invention.

DESCRIPTION OF THE PREFERRED EMBODIMENT

Figure 1:
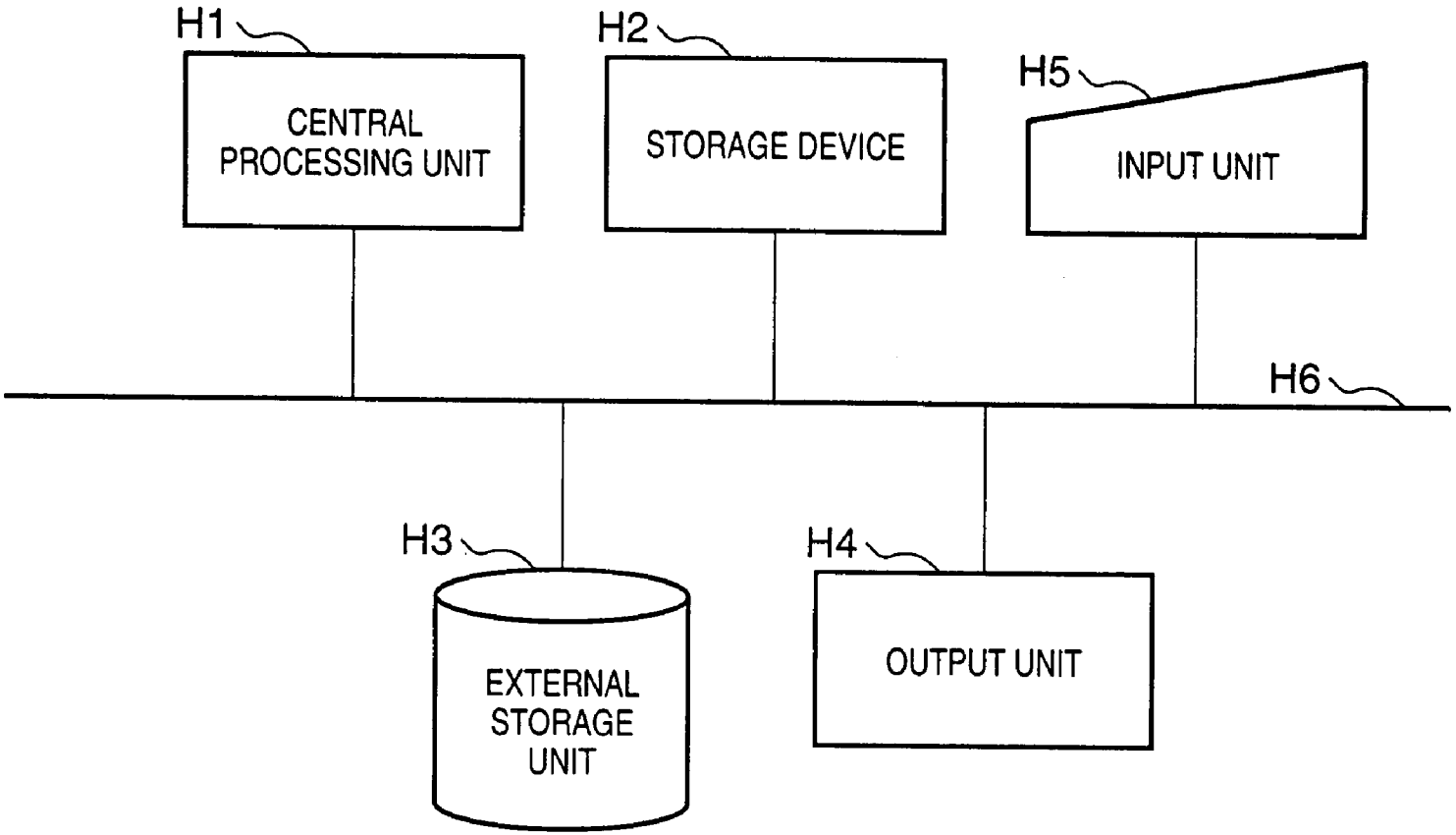
FIG. 1 is a block diagram illustrating a hardware configuration according to an embodiment of the present invention.

FIG. 1 is a block diagram illustrating a hardware configuration according to an embodiment of the present invention.

As shown in FIG. 1, the hardware includes a central processing unit H1 for executing processing such as numerical calculations and control in accordance with a flowcharts described below, a storage device H2 such as a RAM and ROM for storing a control program and temporary data necessary for the procedure and processing described later, and an external storage unit H3 comprising a hard disk or the like. The external storage unit H3 stores a phoneme lexicon in which phoneme units serving as the basis of synthesized speech have been registered.

The hardware further includes an output unit H4 such as a speaker for outputting synthesized speech. It should be noted, however, that it is possible for this embodiment to be incorporated as part of another apparatus or as part of a program, in which case the output would be connected to the input of the other apparatus or program. Also provided is an input unit H5 such as a keyboard for inputting text that is the object of speech synthesis as well as commands for controlling synthesized sound. It should be noted, however, that it is possible for the present invention to be incorporated as part of another apparatus or as part of a program, in which case the input would be made indirectly through the other apparatus or program. Examples of the other apparatus include a car navigation apparatus, a telephone answering machine and other household electrical appliances. An example of input other than from a keyboard is textual information distributed through, e.g., a communications line. An example of output other than from a speaker is output to a telephone line, recording on a recording device such as a minidisc, etc. A bus H6 connects these components together.

Voice synthesizing processing according to this embodiment of the present invention will now be described based upon the hardware configuration set forth above. An overview of processing according to this embodiment will be described with reference to FIGS. 4A to 4D before describing the details of the processing procedure.

Figures 4A, 4B, 4C, 4D:
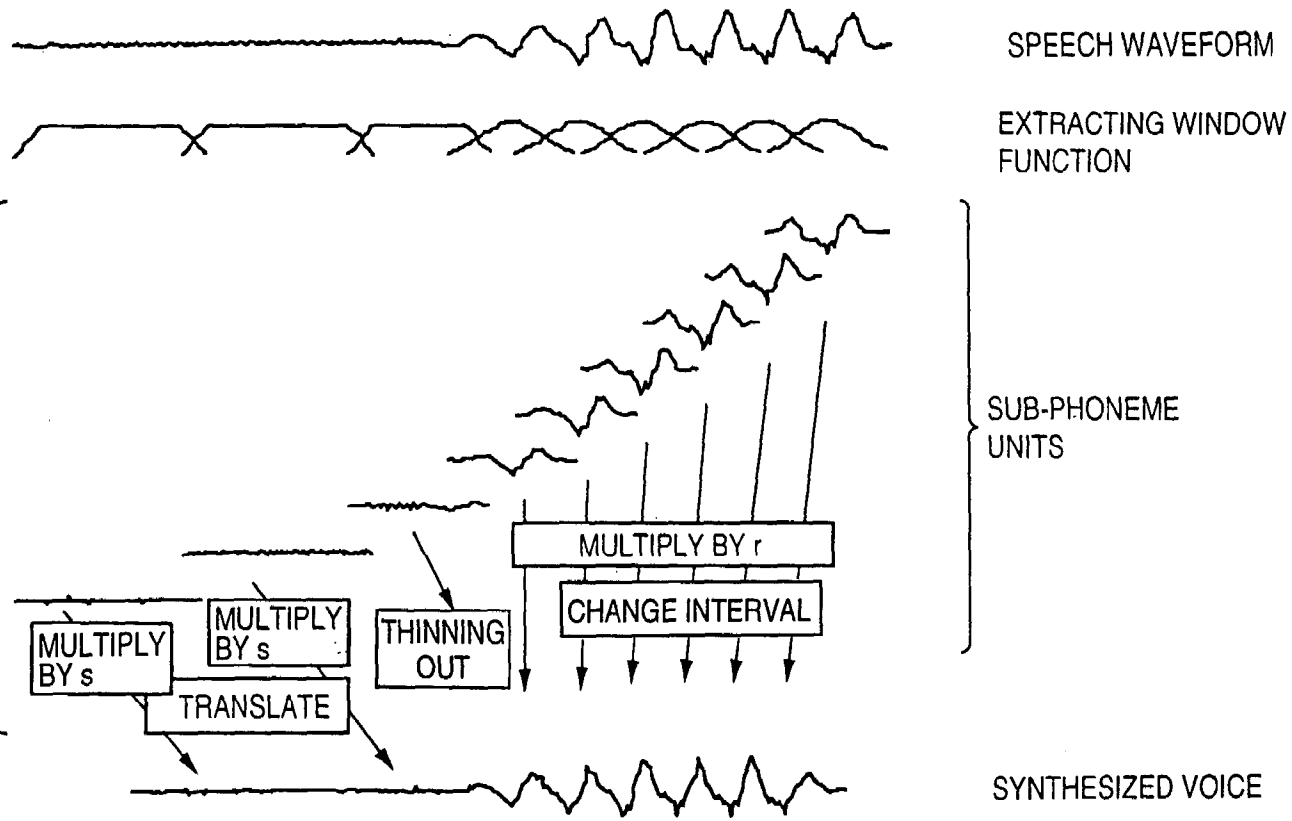
FIGS. 4A to 4D are diagrams useful in describing an overview of power control in speech synthesizing processing according to this embodiment.
Figures 5A, 5B, 5C, 5D:
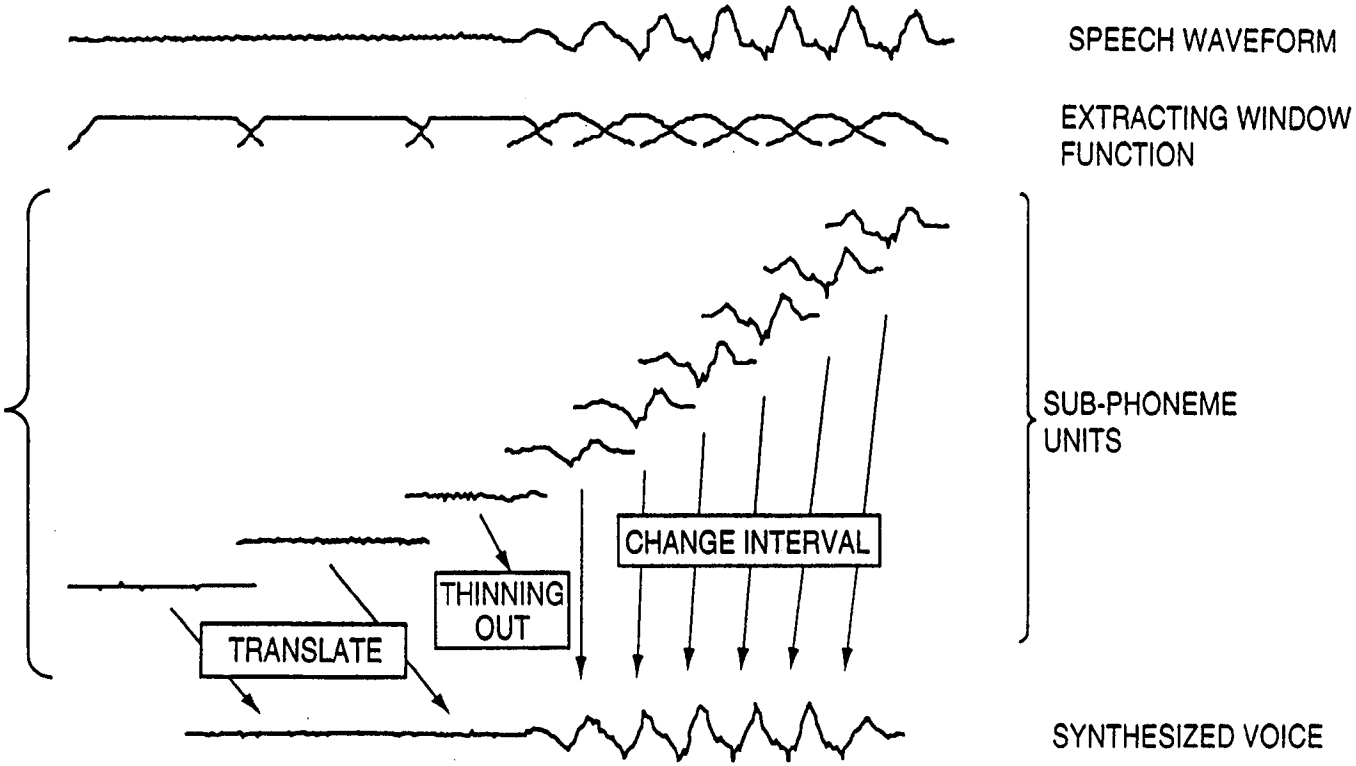
FIGS. 5A to 5D are diagrams schematically illustrating a method of dividing a speech waveform into sub-phoneme units.
Figures 6A, 6B, 6C, 6D, 6E:
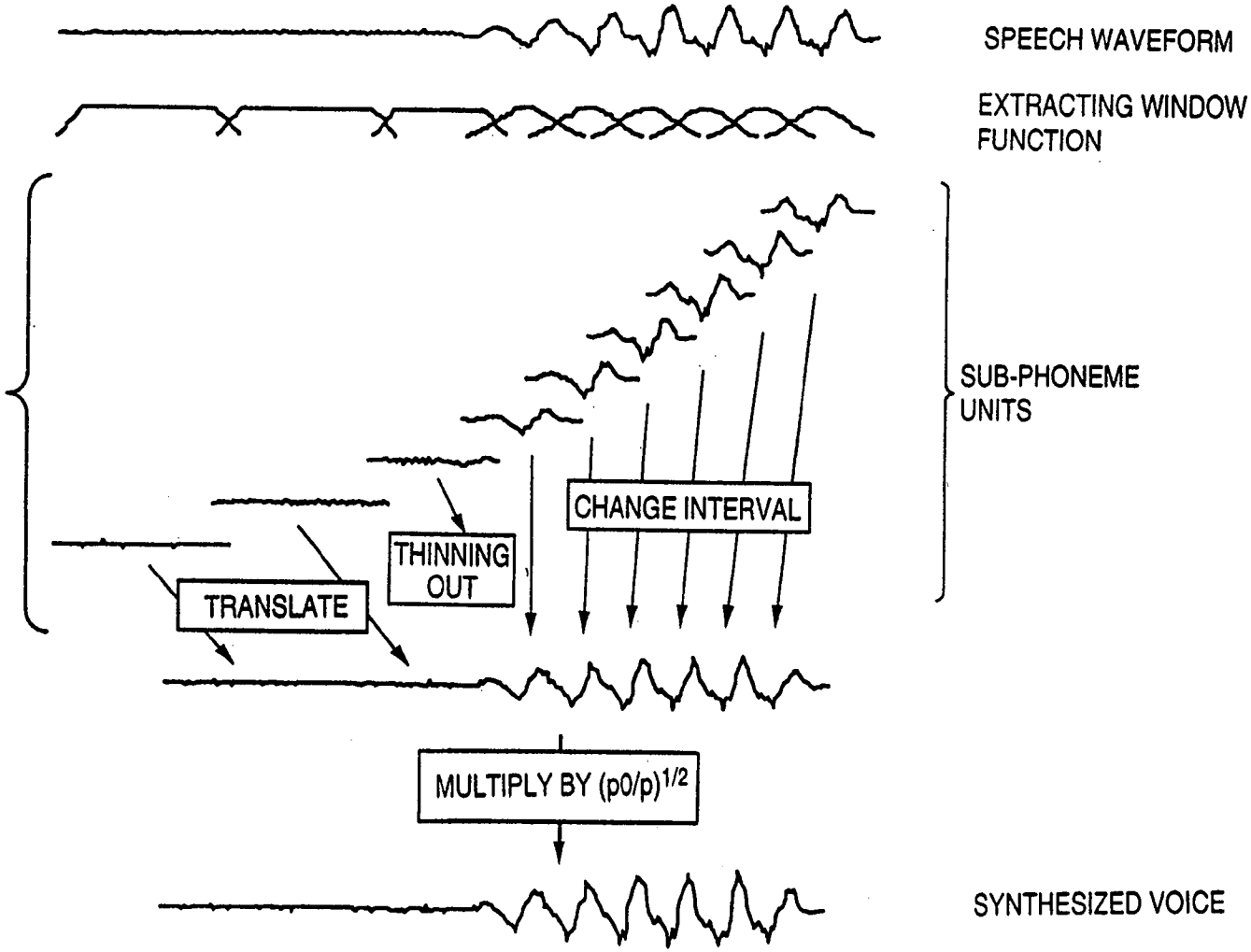
FIGS. 6A to 6E are diagrams useful in describing ordinary control of synthesized speech power.

FIGS. 4A to 4D are diagrams useful in describing an overview of power control in speech synthesizing processing according to this embodiment. According to the embodiment, an amplitude magnification s of the sub-phoneme waveform of an unvoiced portion and an amplitude magnification r of the sub-phoneme waveform of a voiced portion are decided, the amplitude of each sub-phoneme unit is changed and then sub-phoneme unit repetition, thinning out and interval modification processing are executed. The sub-phoneme units are superposed again to thereby obtain synthesized speech having the desired power, as shown in FIG. 4D.

Figure 2:
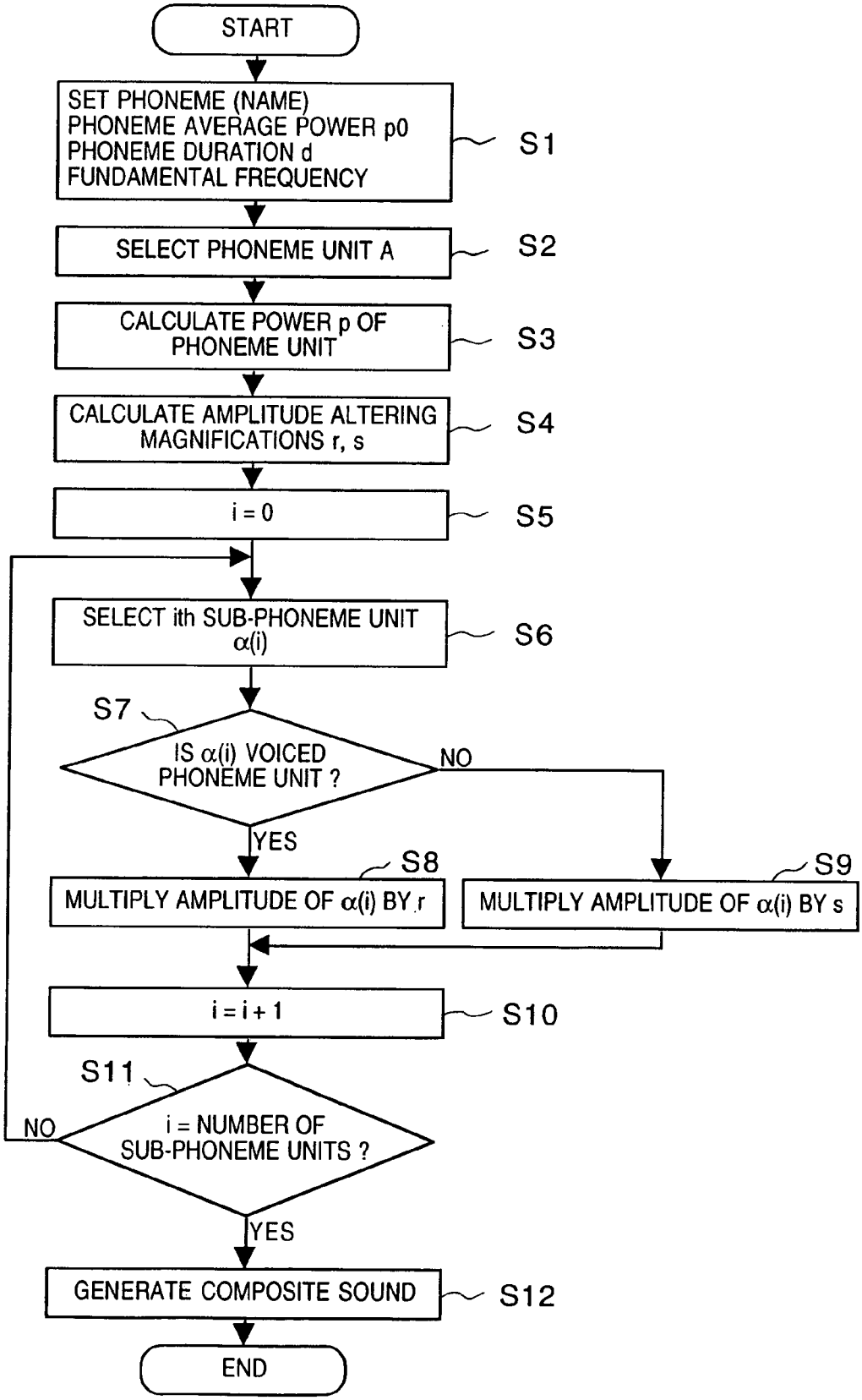
FIG. 2 is a flowchart illustrating speech synthesizing processing according to this embodiment.

FIG. 2 is a flowchart illustrating processing according to the present invention. The present invention will now be described in accordance with this flowchart.

Parameters regarding the object of synthesis processing are set at step S1. In this embodiment, a phoneme (name), average power $p_0$ of the phoneme of interest, duration d and a time series f(t) of the fundamental frequency are set as the parameters. These values may be input directly via the input unit H5 or calculated by another module using the results of language analysis or the results of statistical processing applied to input text.

Next, at step S2, a phoneme unit A on the basis of which a phoneme to be synthesized is based is selected from a phoneme lexicon. The most basic criterion for selecting the phoneme unit A is phoneme name, mentioned above. Other selection criteria that can be used include ease of connection to phoneme units (which may be the names of the phoneme units) on either side, and "nearness" to the duration, fundamental frequency and power that are the targets in synthesis. The average power p of the phoneme unit A is calculated at step S3. Average power is calculated as the time average of the square of amplitude. It should be noted that the average power of a phoneme unit may be calculated and stored on a disk or the like beforehand. Then, when a phoneme is to be synthesized, the average power may be read out of the disk rather than being calculated. This is followed by calculating, at step S4, the magnification r applied to a voiced sound and the magnification s applied to an unvoiced sound for the purpose of changing the amplitude of the phoneme unit. The details of the processing of step S4 for calculating the amplitude altering magnifications will be described later with reference to FIG. 3.

A loop counter i is initialized to 0 at step S5.

Next, at step S6, an ith sub-phoneme unit $\alpha(i)$ is selected from the sub-phoneme units constituting the phoneme unit A. The sub-phoneme unit $\alpha(i)$ is obtained by multiplying the phoneme unit, which is of the kind shown in FIG. 4A, by the window function illustrated in FIG. 4B.

Next, at step S7, it is determined whether the sub-phoneme unit $\alpha(i)$ selected at step S6 is a voiced or unvoiced sub-phoneme unit. Processing branches depending upon the determination made. Control proceeds to S8 if $\alpha(i)$ is voiced and to step S9 if $\alpha(i)$ is unvoiced.

The amplitude of a voiced sub-phoneme unit is altered at step S8. Specifically, the amplitude of the sub-phoneme unit $\alpha(i)$ is multiplied by r, which is the amplitude altering magnification found at step S4, after which control proceeds to step S10. On the other hand, the amplitude of an unvoiced sub-phoneme unit is altered at step S9. Specifically, the amplitude of the sub-phoneme unit $\alpha(i)$ is multiplied by s, which is the amplitude altering magnification found at step S4, after which control proceeds to step S10.

The value of the loop counter i is incremented at step S10. Next, at step S11, it is determined whether the count in loop counter i is equal to the number of sub-phoneme units contained in the phoneme unit A. Control proceeds to step S12 if the two are equal and to step S6 if the two are not equal.

A composite sound is generated at step S12 by subjecting the sub-phoneme unit that has been multiplied by r or s in the manner described to waveshaping and waveform-connecting processing in conformity with the fundamental frequency f(t) and duration d set at step S1.

Figure 3:
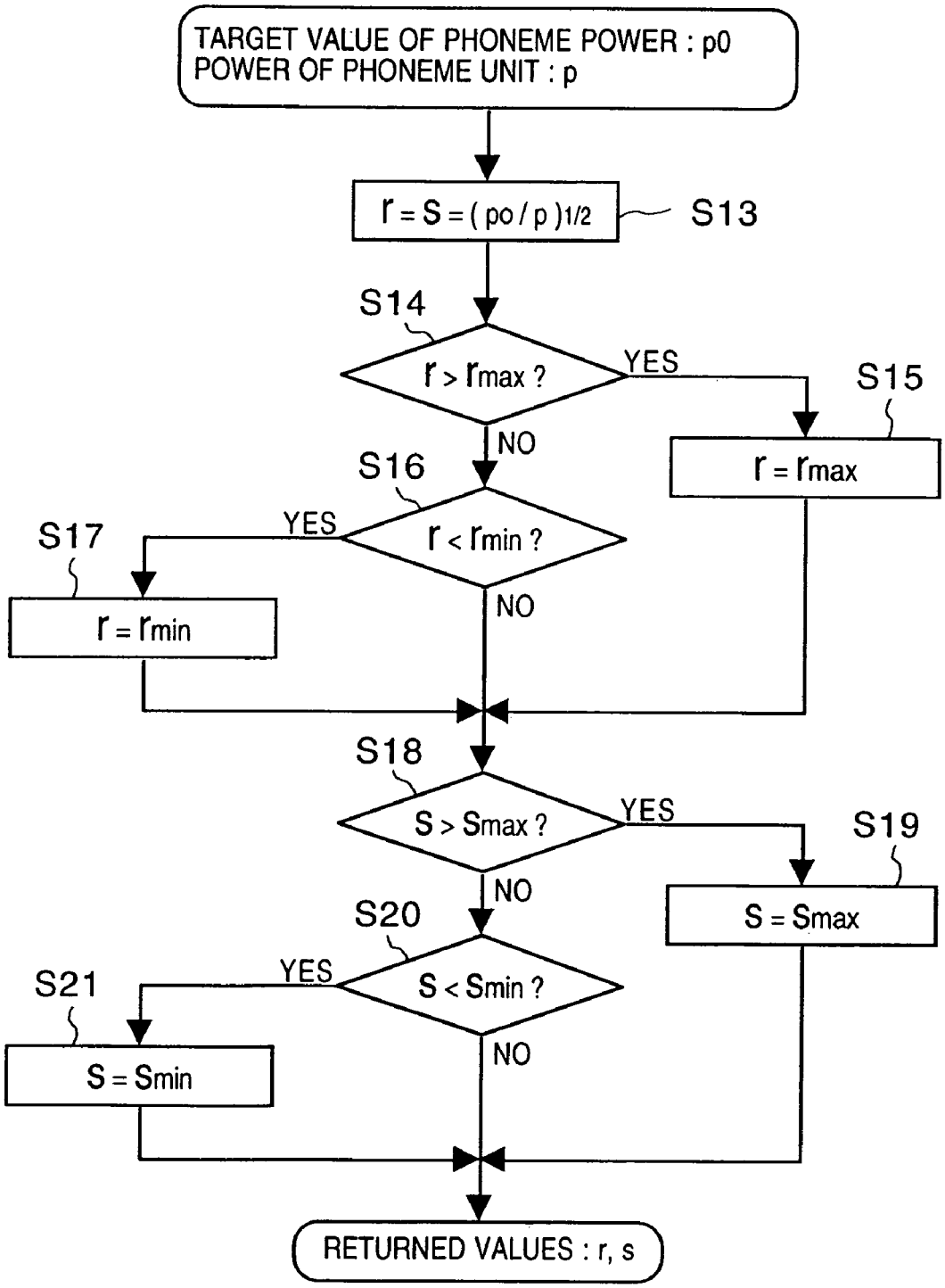
FIG. 3 is a flowchart illustrating the details of processing (step S4) for calculating amplitude altering magnifications.

The details of the processing of step S4 for calculating the amplitude altering magnifications will now be described. FIG. 3 is a flowchart showing the details of this processing.

Initial setting of amplitude altering magnification is performed at step S13. In this embodiment, the amplitude altering magnifications are set to $\sqrt{p_0/p}$. Next, it is determined at step S14 whether the amplitude altering magnification r to be applied to a voiced sound is greater than an allowable upper-limit value $r_{max}$. If the result of the determination is that $r>r_{max}$ holds, control proceeds to step S15, where the value of r is clipped at the upper-limit value of the amplitude altering magnification applied to voiced sound. That is, the amplitude altering magnification r applied to voiced sound is set to the upper-limit value $r_{max}$ at step S15. Control then proceeds to step S18. If it is found at step S14 that $r>r_{max}$ does not hold, on the other hand, control proceeds to step S16. Here it is determined whether the amplitude altering magnification r to be applied to a voiced sound is less than an allowable lower-limit value $r_{min}$. If $r<r_{min}$ holds, control proceeds to step S17. If $r<r_{min}$ does not hold, then control proceeds to step S18. At step S17 the value of r is clipped at the lower-limit value of the amplitude altering magnification applied to voiced sound. That is, the amplitude altering magnification r applied to voiced sound is set to the lower-limit value $r_{min}$. Control then proceeds to step S18.

It is determined at step S18 whether the amplitude altering magnification s to be applied to an unvoiced sound is greater than an allowable upper-limit value $s_{max}$ Control proceeds to step S19 if $s>s_{max}$ holds and to step S20 if $s>s_{max}$ does not hold. At step S19 the value of s is clipped at the upper-limit value of the amplitude altering magnification applied to unvoiced sound. That is, the amplitude altering magnification s applied to unvoiced sound is set to the upper-limit value $s_{max}$. Calculation of this amplitude altering magnification is then terminated. On the other hand, it is determined at step S20 whether the amplitude altering magnification s to be applied to an unvoiced sound is less than an allowable lower-limit value $s_{min}$. If $s<s_{min}$ holds, control proceeds to step S21. If $s<s_{min}$ does not hold, then calculation of this amplitude altering magnification is terminated. At step S21 the value of r is clipped at the lower-limit value of the amplitude altering magnification applied to unvoiced sound. That is, the amplitude altering magnification s applied to unvoiced sound is set to the lower-limit value $s_{min}$. Calculation of these amplitude altering magnifications is then terminated.

In accordance with the embodiment of the present invention, as described above, when synthesized speech conforming to a set power is to be obtained, the amplitudes of sub-phoneme units are altered by amplitude altering magnifications adapted to respective ones of voiced and unvoiced sounds. This makes it possible to obtain synthesized speech of good quality. In particular, since the amplitude altering magnification of unvoiced speech is clipped at a predetermined magnitude, abnormal noise-like sound in unvoiced portions is reduced.

There are instances where power target value in a speech synthesizing apparatus is itself an estimate found through some method or other. In order to deal with an abnormal value ascribable to an estimation error in such cases, the clipping at the upper and lower limits in the processing of FIG. 3 is executed to avoid using magnifications that are not reasonable. Further, there are instances where the determinations concerning voiced and unvoiced sounds cannot be made with certainty and the two cannot be clearly distinguished from each other. In such cases an upper-limit value is provided in regard to voiced sound for the purpose of dealing with judgment errors concerning voice and unvoiced sounds.

In the embodiment described above, one target value p of power is set per phoneme. However, it is also possible to divide a phoneme into N-number of intervals and set a target value $p_k$ ($1 \leqq k \leqq N$) of power in each interval. In such case the above-described processing would be applied to each interval of the N-number of intervals. That is, it would suffice to apply the above-described processing of FIGS. 2 and 3 by treating the speech waveform in each interval as an independent phoneme.

Further, the foregoing embodiment illustrates a method multiplying the phoneme unit A by a window function as the method of obtaining the sub-phoneme unit $\alpha(i)$. However, sub-phoneme units may be obtained by more complicated signal processing. For example, the phoneme unit A may be subjected to cepstrum analysis in a suitable interval and use may be made of an impulse response waveform in the filter obtained.

Figure 7:
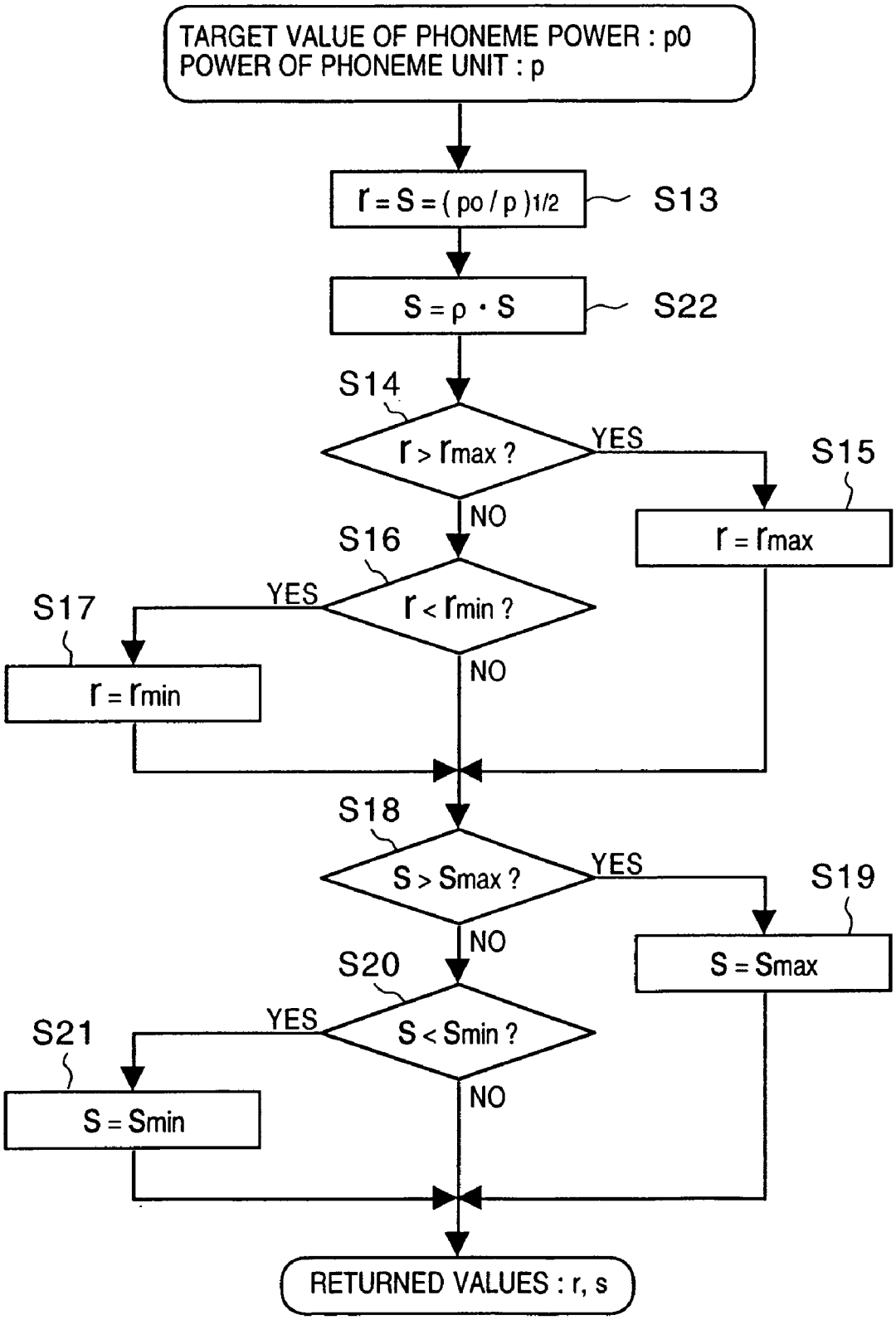
FIG. 7 is a flowchart showing another sequence of the calculation processing of an amplitude altering magnification.

Note that in the flowchart shown in FIG. 3, although the amplitude altering magnification r to be applied to the voiced sub-phoneme unit and the amplitude altering magnification s to be applied to the unvoiced sub-phoneme unit are set in the same value (step S13), then altered in the subsequent clipping processing, the method of determining the values of amplitude altering magnifications r and s is not limited to this. The amplitude altering magnifications r and s may be set in different values prior to performing clipping. FIG. 7 is a flowchart showing an example of such processing steps. Note that in FIG. 7, with regard to the same processing steps as that in FIG. 3, the same reference numerals are assigned and detailed description thereof is omitted herein.

In FIG. 7, step S22 is added after step S13. In step S22, the amplitude altering magnification r to be applied an unvoiced sound is multiplied by $\rho(0 \leqq \rho \leqq 1)$ so as to suppress power of the unvoiced portion. Herein, $\rho$ may be a constant value or a value determined by a condition such as a name of a phoneme unit. By this, the amplitude altering magnifications r and s can be set in different values regardless of clipping processing. Furthermore, by setting a value $\rho$ in association with each phoneme, the amplitude altering magnification s can be set more appropriately.

The present invention can be applied to a system constituted by a plurality of devices (e.g., a host computer, interface, reader, printer, etc.) or to an apparatus comprising a single device (e.g., a copier or facsimile machine, etc.).

Furthermore, it goes without saying that the invention is applicable also to a case where the object of the invention is attained by supplying a storage medium storing the program codes of the software for performing the functions of the foregoing embodiment to a system or an apparatus, reading the program codes with a computer (e.g., a CPU or MPU) of the system or apparatus from the storage medium, and then executing the program codes.

In this case, the program codes read from the storage medium implement the novel functions of the invention, and the storage medium storing the program codes constitutes the invention.

Further, the storage medium, such as a floppy disk, hard disk, optical disk, magneto-optical disk, CD-ROM, CD-R, magnetic tape, non-volatile type memory card or ROM can be used to provide the program codes.

Furthermore, besides the case where the aforesaid functions according to the embodiment are implemented by executing the program codes read by a computer, it goes without saying that the present invention covers a case where an operating system or the like running on the computer performs a part of or the entire process in accordance with the designation of program codes and implements the functions according to the embodiments.

It goes without saying that the present invention further covers a case where, after the program codes read from the storage medium are written in a function expansion board inserted into the computer or in a memory provided in a function expansion unit connected to the computer, a CPU or the like contained in the function expansion board or function expansion unit performs a part of or the entire process in accordance with the designation of program codes and implements the function of the above embodiment.

Thus, in accordance with the present invention, as described above, amplitude altering magnifications which differ for voiced and unvoiced sounds are used to perform multiplication when the power of synthesized speech is controlled. This makes possible speech synthesis in which noise-like abnormal sounds are produced in unvoiced sound.

As many apparently widely different embodiments of the present invention can be made without departing from the spirit and scope thereof, it is to be understood that the invention is not limited to the specific embodiments thereof except as defined in the appended claims.

The invention claimed is:

1. A method of synthesizing speech comprising:

an average power acquisition step of obtaining average power of a phoneme unit to be synthesized;

a magnification acquisition step of obtaining, on the basis of target power of synthesized speech and average power obtained at said average power acquisition step, a first magnification to be applied to sub-phoneme unit of a voiced portion and a second magnification to be applied to sub-phoneme units of an unvoiced portion, wherein said first magnification is different from said second magnification;

a first limitation step of obtaining a third magnification by limiting data range of said first magnification, wherein said first magnification is compared with threshold;

a second limitation step of obtaining a fourth magnification by limiting data range of said second magnification, wherein said second magnification is compared with threshold;

an extraction step of extracting sub-phoneme units from a phoneme to be synthesized;

an amplitude altering step of altering amplitude of a sub-phoneme unit of a voiced portion of speech waveform, by applying the third magnification to speech waveform of the sub-phoneme, from among the sub-phoneme units extracted at said extraction step, and altering amplitude of a sub-phoneme unit of an unvoiced portion of speech waveform, from among the sub-phoneme units extracted at said extraction step, by applying the fourth magnification to speech waveform of the sub-phoneme, said amplitude being altered in discrete intervals, and wherein said application of second magnification to the unvoiced portion causes suppression of power of the unvoiced portion; and a synthesizing step of obtaining synthesized speech using the sub-phoneme units processed at said amplitude altering step.

2. The method according to claim 1, wherein said magnification acquisition step obtains the first and second magnifications by determining an amplitude magnification of the voiced portion of the phoneme unit and an amplitude magnification of the unvoiced portion of the phoneme unit based upon the target power and average power, and clipping the amplitude magnifications of the respective voiced and unvoiced portions at upper-limit values set for respective ones of the voiced and unvoiced portions.

3. The method according to claim 1, wherein said magnification acquisition step obtains the first and second magnifications by determining an amplitude magnification of the voiced portion of the phoneme unit and an amplitude magnification of the unvoiced portion of the phoneme unit based upon the target power and average power, and clipping the amplitude magnifications of the respective voiced and unvoiced portions at lower-limit values set for respective ones of the voiced and unvoiced portions.

4. The method according to claim 1, wherein said synthesizing step includes applying at least one of sub-phoneme unit thinning out, repetition and modification of connection interval when speech is generated using sub-phoneme units generated at said amplitude altering step.

5. The method according to claim 1, wherein said extraction step extracts a sub-phoneme unit by applying a window function to a phoneme unit to be synthesized.

6. The method according to claim 5, wherein the window function is such that an extracting interval at a voiced portion differs from that at an unvoiced portion.

7. An apparatus for synthesizing speech comprising:

average power acquisition means for obtaining average power of a phoneme unit to be synthesized;

magnification acquisition means for obtaining, on the basis of target power of synthesized speech and average power obtained by said average power acquisition means, a first magnification to be applied to sub-phoneme unit of a voiced portion and a second magnification to be applied to sub-phoneme units of an unvoiced portion, wherein said first magnification is different from said second magnification;

first limitation means for obtaining a third magnification by limiting data range of said first magnification, wherein said first magnification is compared with threshold;

second limitation means for obtaining a fourth magnification by limiting data range of said second magnification, wherein said second magnification is compared with threshold;

extraction means for extracting sub-phoneme units from a phoneme to be synthesized;

amplitude altering means for altering amplitude of a sub-phoneme unit of a voiced portion of speech waveform, by applying the third magnification to speech waveform of the sub-phoneme, from among the sub-phoneme units extracted by said extraction means, and altering amplitude of a sub-phoneme unit of an unvoiced portion of speech waveform, from among the sub-phoneme units extracted by said extraction means, by applying the fourth magnification to speech waveform of the sub-phoneme, said amplitude being altered in discrete intervals, and wherein said application of second magnification to the unvoiced portion causes suppression of power of the unvoiced portion; and synthesizing means for obtaining synthesized speech using the sub-phoneme units processed by said amplitude altering means.

8. The apparatus according to claim 7, wherein said magnification acquisition means obtains the first and second magnifications by determining an amplitude magnification of the voiced portion of the phoneme unit and an amplitude magnification of the unvoiced portion of the phoneme unit based upon the target power and average power, and clipping the amplitude magnifications of the respective voiced and unvoiced portions at upper-limit values set for respective ones of the voiced and unvoiced portions.

9. The apparatus according to claim 7, wherein said magnification acquisition means obtains the first and second magnifications by determining an amplitude magnification of the voiced portion of the phoneme unit and an amplitude magnification of the unvoiced portion of the phoneme unit based upon the target power and average power, and clipping the amplitude magnifications of the respective voiced and unvoiced portions at lower-limit values set for respective ones of the voiced and unvoiced portions.

10. The apparatus according to claim 7, wherein said synthesizing means applies at least one of sub-phoneme unit thinning out, repetition and modification of connection interval when speech is generated using sub-phoneme units generated by said amplitude altering means.

11. The apparatus according to claim 7, wherein said extraction means extracts a sub-phoneme unit by applying a window function to a phoneme unit to be synthesized.

12. The apparatus according to claim 11, wherein the window function is such that an extracting interval at a voiced portion differs from that at an unvoiced portion.

13. A storage medium storing a control program for causing a computer to execute speech synthesizing processing, said control program having:

code of an average power acquisition step of obtaining average power of a phoneme unit to be synthesized;

code of a magnification acquisition step of obtaining, on the basis of target power of synthesized speech and average power obtained at said average power acquisition step, a first magnification to be applied to sub-phoneme unit of a voiced portion and a second magnification to be applied to sub-phoneme units of an unvoiced portion, wherein said first magnification is different from said second magnification;

code of a first limitation step of obtaining a third magnification by limiting data range of said first magnification, wherein said first magnification is compared with threshold;

code of a second limitation step of obtaining a fourth magnification by limiting data range of said second magnification, wherein said second magnification is compared with threshold;

code of an extraction step of extracting sub-phoneme units from a phoneme to be synthesized;

code of an amplitude altering step of altering amplitude of a sub-phoneme unit of a voiced portion of speech waveform, by applying the third magnification to speech waveform of the sub-phoneme, from among the sub-phoneme units extracted at said extraction step, and altering amplitude of a sub-phoneme unit of an unvoiced portion of speech waveform, from among the sub-phoneme units extracted at said extraction step, by applying the fourth magnification to speech waveform of the sub-phoneme, said amplitude being altered in discrete intervals, and wherein said application of second magnification to the unvoiced portion causes suppression of power of the unvoiced portion; and code of a synthesizing step of obtaining synthesized speech using the sub-phoneme units processed at said amplitude altering step.

14. The storage medium according to claim 13, wherein said magnification acquisition step obtains the first and second magnifications by determining an amplitude magnification of the voiced portion of the phoneme unit and an amplitude magnification of the unvoiced portion of the phoneme unit based upon the target power and average power, and clipping the amplitude magnifications of the respective voiced and unvoiced portions at upper-limit values set for respective ones of the voiced and unvoiced portions.

15. The storage medium according to claim 13, wherein said magnification acquisition step obtains the first and second magnifications by determining an amplitude magnification of the voiced portion of the phoneme unit and an amplitude magnification of the unvoiced portion of the phoneme unit based upon the target power and average power, and clipping the amplitude magnifications of the respective voiced and unvoiced portions at lower-limit values set for respective ones of the voiced and unvoiced portions.

16. The storage medium according to claim 13, wherein said synthesizing step includes applying at least one of sub-phoneme unit thinning out, repetition and modification of connection interval when speech is generated using sub-phoneme units generated at said amplitude altering step.

17. The storage medium according to claim 13, wherein said extraction step extracts a sub-phoneme unit by applying a window function to a phoneme unit to be synthesized.

18. The storage medium according to claim 17, wherein the window function is such that an extracting interval at a voiced portion differs from that at an unvoiced portion.

* * * * *

UNITED STATES PATENT AND TRADEMARK OFFICE

CERTIFICATE OF CORRECTION

PATENT NO. : 7,162,417 B2
APPLICATION NO. : 11/181462
DATED : January 9, 2007
INVENTOR(S) : Masayuki Yamada, Yasuhiro Komori and Mitsuru Otsuka It is certified that error appears in the above-identified patent and that said Letters Patent is hereby corrected as shown below:

On the Title Page:
In item (54); and column 1, line 1
Delete "Speech Synthesizing Method And Apparatus For Altering Amplitudes Of Voiced And Invoiced Portions" and insert therefore --Speech Synthesizing Method And Apparatus For Altering Amplitudes Of Voiced and Unvoiced Portions--

Signed and Sealed this

Fifteenth Day of May, 2007

JON W. DUDAS
*Director of the United States Patent and Trademark Office*